United States Patent [19]

Faulhaber

[11] 3,999,056

[45] Dec. 21, 1976

[54] HEADLIGHT

[76] Inventor: Fritz Faulhaber, CH-6981 Vernate, Switzerland

[22] Filed: Jan. 10, 1975

[21] Appl. No.: 540,156

[30] Foreign Application Priority Data

Jan. 11, 1974 Austria ..... 213/74

[52] U.S. Cl. ..... 240/41 R; 240/41.4 R

[51] Int. Cl.[2] ..... F21M 3/04

[58] Field of Search ..... 240/41 R, 7.1 R, 11.4 R, 240/41.3, 41.4, 41.35 R, 46.01

[56] References Cited

UNITED STATES PATENTS

| | | | |
|---|---|---|---|
| 1,557,729 | 10/1925 | Siefert | 240/41.3 |
| 3,371,202 | 2/1968 | Moore et al. | 240/41.3 X |
| 3,598,989 | 8/1971 | Biggs | 240/41.3 X |
| 3,796,886 | 3/1974 | Freeman | 240/41.3 X |

FOREIGN PATENTS OR APPLICATIONS

| | | |
|---|---|---|
| 1,804,981 | 6/1970 | Germany |

*Primary Examiner*—R.L. Moses
*Attorney, Agent, or Firm*—Hans Berman

[57] ABSTRACT

A mercury arc lamp and a condenser lens system are mounted in the housing of a headlight in such a manner that the lens system produces a luminous image of the arc in the housing contiguously adjacent an aperture in the opaque front wall of the housing, the image being not greater than 2 cm² when viewed through the aperture, but producing an adequate illuminating beam. The headlight appears to a viewer as a brilliantly luminous point whose afterimage is too small to have a persistent blinding effect.

8 Claims, 2 Drawing Figures

HEADLIGHT

This invention relates to beam-producing light sources and particularly to a headlight suitable for a vehicle.

Conventional headlights essentially consist of an incandescent electric light bulb and a reflector which projects a light beam outward of the headlight enclosure. When viewed head-on, the usual headlight appears as a luminous circle of approximately 20 cm diameter which occupies an arc of one minute in the field of view from a distance of about 700 meters, a correspondingly large arc at closer range, and has a severe and persistent blinding effect with the usual light sources having a brightness of the order of 1000 stilb.

It has now been found that the brightness of a headlight is relatively irrelevant to the blinding aftereffect if the luminous area in the field of view is very small. More specifically, it has been found that even very intense light emanating from a luminous area not greater than 2 square centimeters, although momentarily blinding and producing a retina image including luminous secondary rays and circles, leaves so small an afterimage that practically complete vision is restored instantaneously when exposure of the eye to the intense light terminates.

The invention is based on this finding, and it is its primary object to provide a headlight which does not produce a significant, persistent blinding effect on the driver of an oncoming vehicle. The headlight of the invention has a housing whose opaque front wall is formed with an aperture. An electrically energized light source is provided in the housing together with optical means for producing a luminous image of the source contiguously adjacent the aperture in the front wall, the image when viewed through the aperture being not greater than two square centimeters and smaller than the aperture.

Preferably, the luminous image is even smaller than 2 $cm^2$, and not greater than one minute of arc when viewed through the aperture from a distance of twenty meters.

Figure 1:
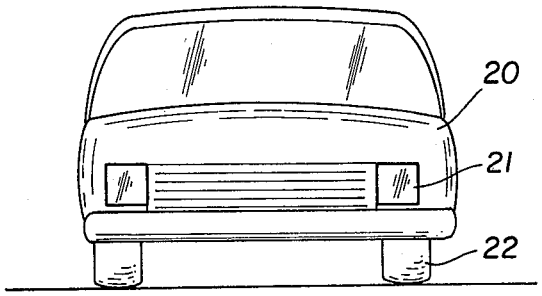
Figure 2:
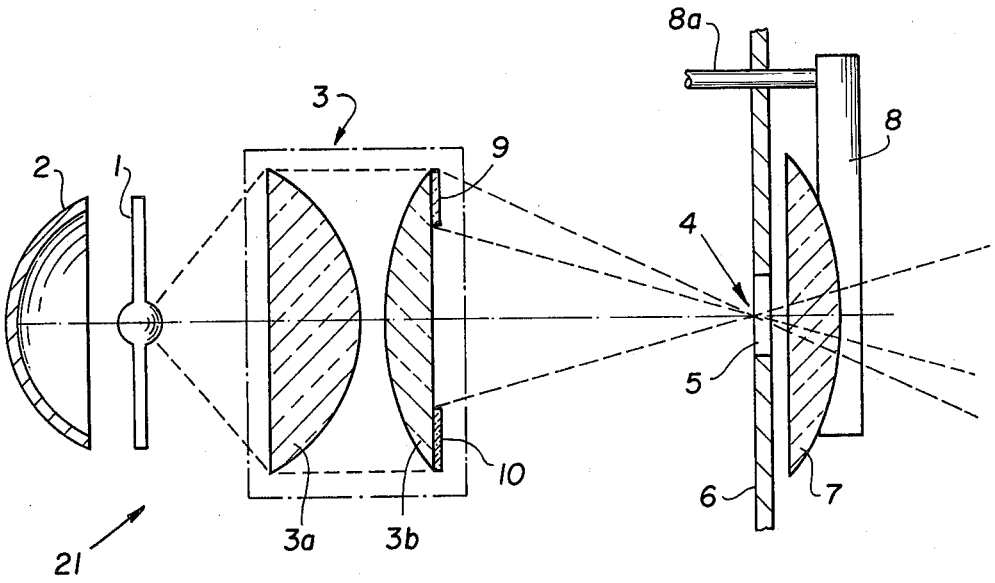

Other features, additional objects, and many of the attendant advantages will readily be appreciated from the following description of a preferred embodiment when considered in connection with the appended drawing in which:

FIG. 1 is a fragmentary, simplified, front-elevational view of a motor car equipped with headlights of the invention; and FIG. 2 shows one of the headlights in the car of FIG. 1 in fragmentary side-elevational section.

The body 20 of the motor car shown in FIG. 1 is equipped with two headlights 21 spaced transversely of the normal direction of vehicle movement between the vehicle tracks defined by the wheels, only the front wheels 22 being indicated. The apparatus shown in FIG. 1 differs from the conventional arrangement by the two identical headlights 21. The essential elements of one headlight 21 are shown in FIG. 2.

The headlight has a housing of which only the opaque front wall 6 is shown. A mercury vapor lamp 1 is mounted in the housing in such a manner that its arc is in the center of curvature of a spherical reflector 2. A condenser lens system 3 receives light emitted by the lamp 1 and partly reflected by the reflector 2. The system consists of a rear lens 3*a* and a front lens 3*b* and produces an enlarged luminous image of the arc in the lamp 1 in a focal area 4 contiguously adjacent a light discharge aperture 5 in the front wall 6.

The aperture 5 is covered by a cylinder lens 7 which extends beyond the aperture 5 in all directions. The face of the lens 7 directed outward of the headlight housing is swept by a wiper blade 8 when a drive shaft 8*a*, journaled in the housing, is oscillated by a non-illustrated motor in a conventional manner. The flat front face of the condenser lens 3*b* is partly covered at the top and bottom respectively by a horizontally elongated, flat bar 9 of tinted glass and by a similarly shaped opaque bar 10.

In an actual embodiment, the lamp 1 was a commercial mercury vapor discharge lamp (Osram, 200 watts) whose arc was 2.2 mm long and 0.6 mm wide. The reflector 2 had a radius of curvature of 30 mm. The condenser lenses 3*a*, 3*b* consisted of transparent fused quartz so as to resist the intense heat of the arc. The rear lens 3*a* had a flat rear face and a front face which somewhat deviated from the illustrated spherical shape in approaching a paraboloid shape for avoiding spherical aberration in the image produced in the area 4. The apex curvature of the lens 3*a* had a radius of curvature of approximately 15 mm. The rear face of the front lens 3*b* was spherical and had a radius of 45 mm. The condenser lens system 3 produced an image of the lamp arc which was enlarged about three times.

The lens 7 had a flat rear face 40 mm square and its cylindrical front face had a radius of curvature of 45 mm and too great to produce significant refraction of the light beam emitted from the aperture 5. The aperture was much smaller than the flat rear face of the lens 7, but somewhat larger than the image of the arc in the area 4. The glass bar 9 of a neutral grey color reduced the otherwise excessive light on the pavement immediately in front of the car, and the opaque bar 10 eliminated unnecessary high light rays from the image of the flat front face of the lens 3*b* projected at an infinite distance by the lens 7. The lens 7 did not have a significant effect on the apparent size of the luminous arc image. The image was presented through the lens 7 as an extremely bright point even when viewed at a distance of only 20 meters.

While cleaning devices for the transparent front closures of headlights have been used prior to this invention, the wiper 8 is of particular importance with the small effective light source employed to avoid a spreading of the beam and the resulting apparent enlargement of the viewed light source image. Obviously, a conventional washer arrangement may supplement the wiper 8 if necessary.

A mercury arc lamp of 200 watts having a brightness of more than 5000 stilbs was chosen in the aforedescribed actual embodiment because it was the only suitable commercial lamp readily available. Tests of the headlight under normal driving conditions indicate that a 100 watt lamp will be adequate to duplicate the effects of conventional sealed-beam headlights employing an incandescent electric lamp.

Preliminary tests indicate that the spherical reflector 2 and the condenser lens system 3 may be replaced by an ellipsoidally curved, concave mirror.

Other changes and variations will readily suggest themselves to those skilled in the art on the basis of the above teachings. It should be understood, therefore, that the invention may be practiced otherwise than as specifically disclosed.

What is claimed is:

1. A headlight for a vehicle comprising:

a. a housing including an opaque front wall formed with an aperture;

b. an electrically energized light source in said housing having a brightness of at least 5000 stilbs when energized;

c. first optical means for producing a luminous image of said source contiguously adjacent said aperture in said housing; and d. second optical means offset from said aperture in a direction away from said light source for presenting said image to a viewer spaced from said housing in said direction as having a size not greater than two square centimeters and smaller than said aperture,

2. A headlight as set forth in claim 1, wherein the luminous image produced by said first optical means is not greater than one minute of arc when viewed by said viewer from a distance of twenty meters.

3. A headlight as set forth in claim 1, wherein said second optical means include lens means mounted on said housing adjacent said aperture for projecting an image of said first optical means outward of said housing.

4. A headlight as set forth in claim 3, wherein said lens means includes a lens member covering said aperture and having respective faces directed inward and outward of said housing respectively, the headlight further comprising wiper means for wiping said outward directed face.

5. A headlight as set forth in claim 3, further comprising means for restricting the light of said source emitted through said aperture to a beam of predetermined cross section, said lens means including a lens member traversed by said beam and extending beyond said beam in all directions at right angles to said beam. *a.*

6. A headlight as set forth in claim 1, wherein said light source includes a gas discharge lamp.

7. A headlight as set forth in claim 1, wherein said first optical means include a condenser lens system, the second optical means including lens means mounted on said housing and projecting an image of said system outward of said housing.

8. A vehicle comprising a body and a headlight as set forth in claim 1 mounted on said body for directing a beam of the light produced by said source in a horizontally extending direction.

* * * * *

UNITED STATES PATENT AND TRADEMARK OFFICE

CERTIFICATE OF CORRECTION

PATENT NO. : 3,999,056

DATED : December 21, 1976

INVENTOR(S) : FRITZ FAULHABER

It is certified that error appears in the above-identified patent and that said Letters Patent are hereby corrected as shown below:

In column 3, line 14, after "ture," insert -- said aperture constituting the sole passage for light from said source outward of said housing in said direction. --

Signed and Sealed this

Fifth Day of April 1977

[SEAL]

*Attest:*

RUTH C. MASON
*Attesting Officer*

C. MARSHALL DANN
*Commissioner of Patents and Trademarks*